United States Patent [19]

Tønnessen

[11] 4,141,465

[45] Feb. 27, 1979

[54] INSULATED TANKS FOR LIQUEFIED GASES

[75] Inventor: Arne Tønnessen, Moss, Norway

[73] Assignee: Moss Rosenberg Verft a.s., Moss, Norway

[21] Appl. No.: 804,257

[22] Filed: Jun. 7, 1977

[30] Foreign Application Priority Data

Aug. 23, 1976 [NO] Norway ..... 762893

[51] Int. Cl.[2] ..... B65D 87/36

[52] U.S. Cl. ..... 220/445

[58] Field of Search ..... 220/9 LG, 15, 445

[56] References Cited

U.S. PATENT DOCUMENTS

| | | | |
|---|---|---|---|
| 3,664,816 | 5/1972 | Finnegan | 228/117 X |
| 3,680,323 | 8/1972 | Bognaes et al. | 220/15 X |
| 3,941,272 | 3/1976 | McLaughlin | 220/15 X |

*Primary Examiner*—Herbert F. Ross

*Attorney, Agent, or Firm*—Pasquale A. Razzano; Harold L. Stults

[57] ABSTRACT

A tank for holding liquefied gas and including a support in the form of a vertical skirt which forms a structural unity with the tank wall. The vertical skirt has an intermediate belt or zone in the region between the transition to the tank wall and the foundation, said zone being made of a bearing material which has the properties of poor heat conductivity relative to that of the material comprising the tank wall and the rest of the skirt, a thermal expansion coefficient which lies between the values for the other skirt materials, and the ability to withstand low temperatures, said zone being thermally insulated.

4 Claims, 3 Drawing Figures

INSULATED TANKS FOR LIQUEFIED GASES

The invention relates to an improvement on the insulated tanks used to hold liquefied gases, where the tank structure includes a support in the form of a vertical skirt which forms a structural unity with the wall of the tank.

In the known spherical tanks which are supported by skirts on board ships, for example, the tank itself and, partially, the skirt are thermally insulated, however, there is still some heat leak into the tank despite the insulation. This results in so-called "boil-off" of the cargo.

On insulated cargo tanks which are designed to transport methane, the maximum boil-off has been calculated to be 0.25% per 24 hours. Increasingly stringent terms in freighting contracts have resulted in a need for reducing this boil-off. On large aluminium tanks having the skirt construction and insulation used at present, the heat flow through the skirt constitutes approximately 35% of the total heat leak into the spherical tank itself. By improving the insulation of the tank within the limits of what seems practically possible today, the heat leak can be reduced by approximately 30%. This means that the percentage of heat leak due to the skirt will then be 50%. Further reduction of the heat leak can only be accomplished by reducing the heat flow through the skirt.

The tank and skirt constitute a monolithic or integral structure. This construction principle provides advantages, both technically and from a safety point of view. It is therefore undesirable to introduce an "insulator" into the skirt, which would mean that the principle of structural unity would be violated.

Calculations show that a strengthening of the insulation on the skirt would result in only small changes in the rate of heat leak (temperature gradient). In addition, it should be noted that the material that is used today for the tank wall and at least the upper part of the skirt is aluminum, a material which has good heat conductivity.

Therefore, the aim of the invention is to introduce a kind of heat brake into the skirt without violating the previously mentioned principle of structural unity, and this is achieved according to the invention in that the vertical skirt has an intermediate belt or zone in the region between the transition to the tank wall and the foundation, said zone being made of a bearing material which has the properties of poor heat conductivity relative to that of the material comprising the tank walls and the rest of the skirt, a thermal expansion coefficient which lies between the values for the other skirt materials, and the ability to withstand low temperatures, said zone being thermally insulated.

One material which would satisfy these conditions is stainless steel, for example, 18-8 SS.

When the skirt is provided with the heat brake of the invention, the heat flow through the skirt can be reduced by 40% - 50%. This means a 15% - 25% reduction of the total heat leak, depending on the tank insulation.

The invention will be explained further with reference to the drawings, where

Figure 1:
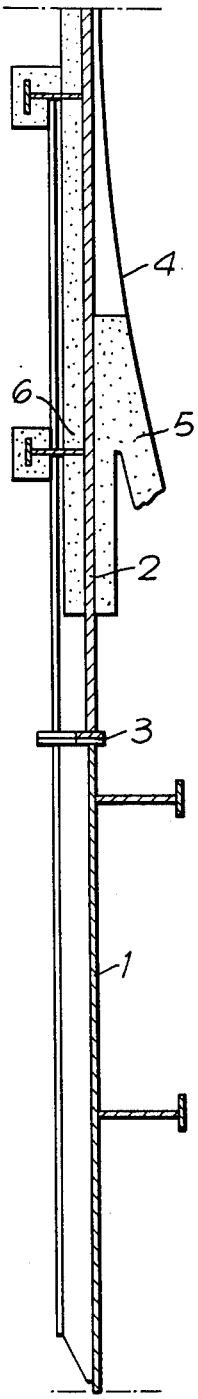
Fig. 1. PRIOR ART
FIG. 1 is a cross section through one known embodiment of the skirt.

FIG. 1 shows how the skirt is constructed with a lower part 1 made of a suitable steel material, and an upper part 2 made of aluminum. The two skirt zones 1 and 2 are welded together at 3 in an appropriate manner. A portion of the wall of the spherical tank is shown on FIG. 1, designated by 4. The spherical tank wall and the upper part of the skirt are insulated as shown by reference numbers 5 and 6, respectively.

Figure 2:
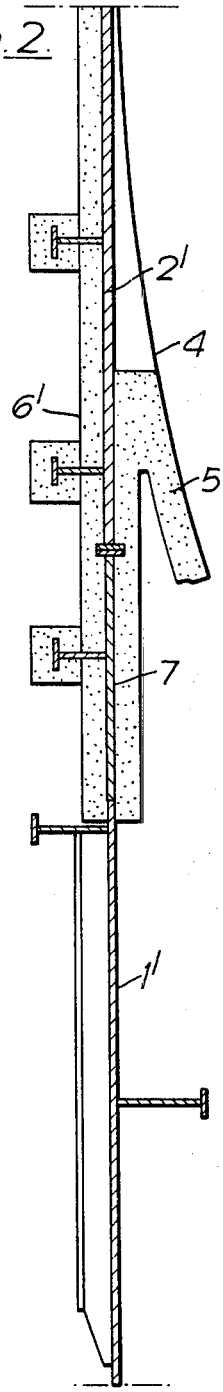
FIG. 2 is a cross section through an embodiment of the skirt according to the invention.

FIG. 2 shows a similar cross section through a new embodiment of the skirt. The lower zone 1' of the skirt is also in this case made of a suitable steel material, while the skirt's upper zone 2' is made of aluminum. The spherical tank wall 4, as in FIG. 1, is made of aluminum. The tank's insulation is designated by 5.

Between its lower zone 1' and its upper zone 2', the skirt is provided with an intermediate belt or zone 7 in accordance with the invention, the zone 7 in this case being made of stainless steel. An example of a suitable material for the zone 7 would be 18-8 stainless steel. The zone 7 is welded into the skirt and thus constitutes a bearing part of the skirt. In this way, one retains the important principle of structural unity mentioned previously. The skirt's insulation 6' is extended down so that it also covers the intermediate zone 7. The insulation in this zone enhances the effect of the heat brake to reduce the gross heat input to the tank structure, from the hull of the ship, by isolating the intermediate zone 7 from the effects of the ambient temperature, thereby to keep the temperature of the skirt's upper zone 2' and of the intermediate zone 7 as low as possible.

Figure 3:
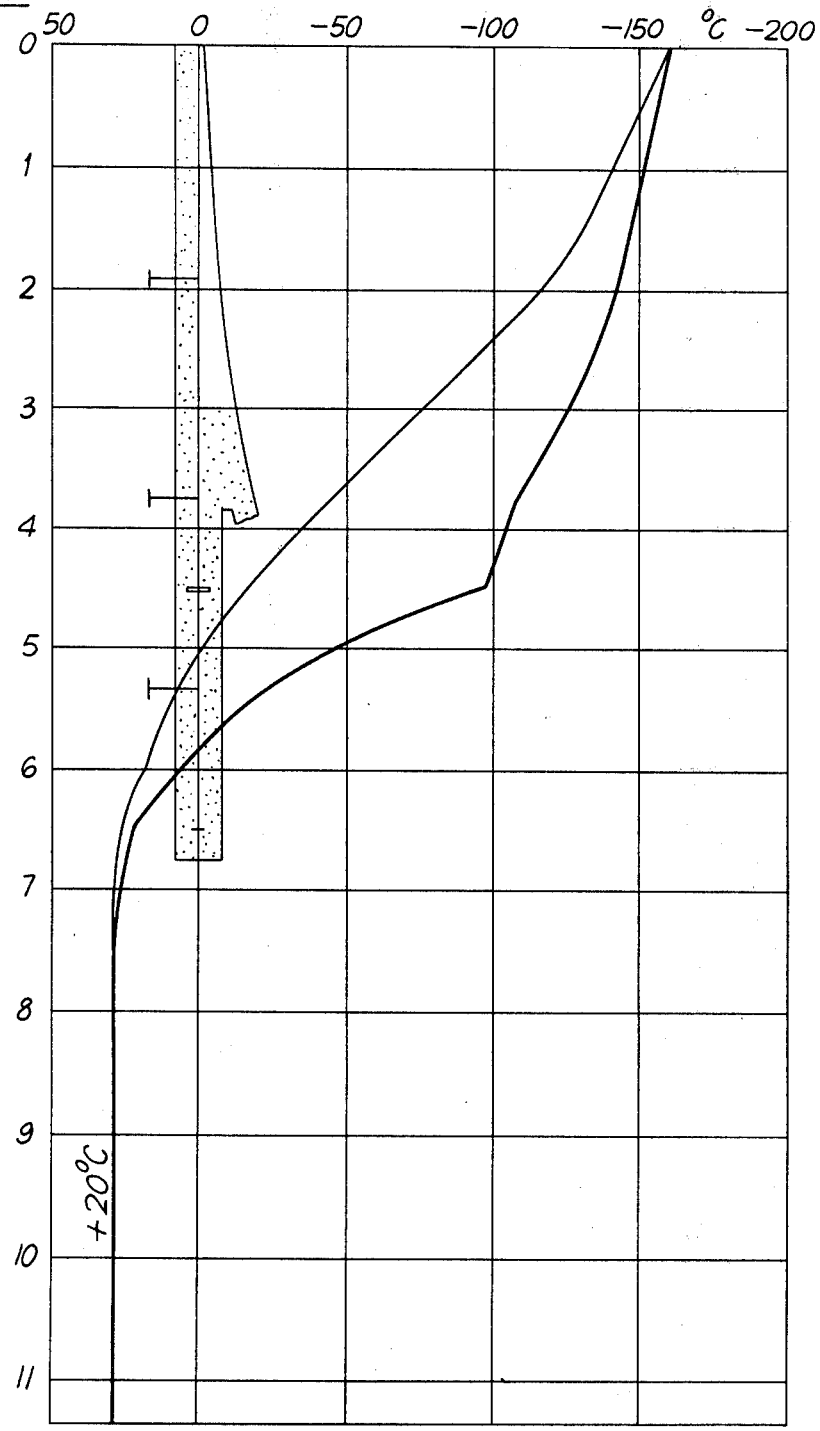
FIG. 3 is a comparative graph of the temperature distributions for the skirts of FIG. 1 and FIG. 2, i.e., without the improvement of the invention and including said improvement.

The temperature distribution in the new skirt construction is shown on FIG. 3, where the principal structural components of the skirt have been drawn in on the diagram. The upper curve shows the temperature distribution on the skirt lacking the heat brake according to the invention, while the lower curve shows the temperature distribution on the skirt provided with the heat brake of the invention. These curves also generally represent an approximation of the thermal stress conditions within the skirt structure, as well as the deflection of the skirt as a result of the temperature conditions therein. Accordingly it will be appreciated that with the heat brake of the present invention, the upper skirt zone 2' will remain more nearly tangent to the tank than will the upper zone of the skirt which does not contain the insulated heat brake system of the present invention. This reduces stress transmittal to the point of juncture between the skirt and the tank.

Having described my invention, I claim:

1. A tank structure for holding liquefied gas comprising, the combination of, a tank adapted to be rigidly mounted on a support structure and adapted to contain liquefied gases; and a support structure including a generally cylindrical integral support skirt having concentric top, intermediate and bottom peripheral skirt portions, with said top skirt portion having an upper end fixed to the tank and a lower edge; said intermediate skirt portion having a top edge fixed to the lower edge of said top skirt portion and extending downwardly to a bottom edge, said bottom peripheral skirt portion having a top edge fixed to said bottom edge of said intermediate skirt portion, and insulation means surrounding said top and intermediate skirt portions to isolate said top and intermediate skirt portions from temperature effects of the surrounding atmosphere, said intermediate skirt portions having a predetermined height and a coefficient of heat conduction which is less than that coefficient of heat conduction of said top and bottom skirt portions, the coefficient of thermal expansion of said intermediate skirt portion being between the respective coefficient of thermal expansion of said top skirt portion and said bottom skirt portion, said top skirt portion being subjected to variations in temperature throughout a range from the ambient temperature to substantially the temperature of liquefied gas in the tank, and said bottom skirt portion being fixed to said support structure and subjected to the temperature of the surrounding atmosphere, with said intermediate skirt portion providing a temperature brake at all temperature differences between said top and bottom skirt portions, which may vary between a minimum value which may be zero degrees and a maximum value which is the difference between the temperature of the atmosphere surrounding the bottom skirt portion and a temperature which approaches that of the liquefied gas, whereby said skirt portions form an integral circumferential support structure irrespective of changes in the temperature of said skirt portions with the circumferential dimensions of said bottom skirt portion varying with the temperature of the surrounding atmosphere while the circumferential dimensions of said top skirt portion vary with change in tank temperature, and the circumferential dimensions of said intermediate skirt portion vary so as to maintain a coextensive relationship with said top skirt portion at its top edge and with said bottom skirt portion at its bottom edge.

2. The tank structure as described in claim 1, wherein said ring is constructed of aluminum and said top ring portion is constructed of 18-8 stainless steel.

3. A tank structure for holding liquefied gas comprising, the combination of, a tank which is adapted to contain liquefied gas and means for supporting said tank on a support structure comprising a generally cylindrical integral support skirt having concentric top, intermediate and bottom peripheral skirt portions, said top skirt portion having a top edge fixed to said tank, said top skirt portion extending downwardly from said tank to its bottom edge, said intermediate peripheral skirt portion being concentric with said top skirt portion and having a top edge mating with and fixed to said bottom edge of said top skirt portion and a bottom edge portion fixed to the top edge of said bottom skirt portion, and insulating means surrounding said top skirt portion and said intermediate skirt portion to isolate said top and intermediate skirt portions from temperature effects of the surrounding atmosphere, said intermediate skirt portion being formed of stainless steel and having a coefficient of heat conduction which is less than the corresponding coefficient of heat conduction of said top skirt portion and said bottom skirt portion, said intermediate skirt portion being subjected to variations in temperature throughout a range from the ambient temperature to substantially the temperature of liquefied gas in the tank, and said bottom skirt portion being fixed to said support structure and subjected to the temperature of the surrounding atmosphere; said intermediate skirt portion providing a temperature brake at all temperature which are the difference between a minimum value that may be zero degrees when said tank is at ambient temperature and a maximum value which is the difference between ambient temperature and substantially the temperature of liquefied gas in the tank, with said skirt portions forming an integral circumferential structure throughout changes in the temperature of said skirt portions, with said bottom skirt portion maintaining substantially the same circumferential dimensions while said top skirt portion's circumferential dimensions vary in accordance with temperature changes in the tank and the circumferential dimensions of said intermediate skirt portion vary to accommodate the upper and bottom skirt portions, whereby said intermediate skirt portion maintains a coextensive relationship with said upper skirt portion at its top edge and with said bottom skirt portion at its bottom edge.

4. A tank structure for holding liquefied gas comprising, in combination, a substantially spherical tank and a support structure formed by a peripheral cylindrical skirt having an upper edge fixed to said tank and extending downwardly therefrom with its bottom edge fixed to a rigid support, insulation means surrounding said tank and the upper portion of said skirt whereby said upper portion of said skirt has its upper edge at substantially the temperature of said tank and its lower edge at substantially the temperature of the surrounding atmosphere, said skirt having a lower portion which is at substantially the temperature of the surrounding atmosphere, the improvement which comprises said skirt having an intermediate annular cylindrical section between said upper and lower skirt portions formed of stainless steel which has a coefficient of heat conduction that is substantially less than the coefficient of heat conduction of the upper portion of the skirt between the tank and said intermediate section; said lower portion of said skirt being formed of steel which has a coefficient of heat conduction that is greater than that of said intermediate portion of said skirt, said insulation extending along said skirt from said tank to a position along the lower portion of the skirt below its junction with said intermediate portion, whereby said intermediate portion of said skirt provides a heat brake between said tank and said lower portion of the skirt which is substantially equal to the difference between the temperature of liquefied gas in said tank and the ambient temperature.

* * * * *

UNITED STATES PATENT AND TRADEMARK OFFICE

CERTIFICATE OF CORRECTION

PATENT NO. : 4,141,465

DATED : February 27, 1979

INVENTOR(S) : Arne Tonnessen

It is certified that error appears in the above-identified patent and that said Letters Patent are hereby corrected as shown below:

In column 3, line 3, "that" is deleted and "the" is substituted therefor.

Signed and Sealed this

*Fifth* Day of *June 1979*

[SEAL]

*Attest:*

RUTH C. MASON
*Attesting Officer*

DONALD W. BANNER
*Commissioner of Patents and Trademarks*